United States Patent [19]

Okamoto et al.

[11] 4,284,344

[45] Aug. 18, 1981

[54] ELECTROPHOTOGRAPHIC DENSITY CONTROL

[75] Inventors: Hiroshi Okamoto, Toyokawa; Tetsuya Yamada, Aichi; Fumitoshi Atsumi, Shizuoka; Isao Iizaka, Shinshiro, all of Japan

[73] Assignee: Minolta Camera Kabushiki Kaisha, Osaka, Japan

[21] Appl. No.: 59,177

[22] Filed: Jul. 20, 1979

[30] Foreign Application Priority Data

Jul. 27, 1978 [JP] Japan ..... 53/92300

[51] Int. Cl.[3] ..... G03G 15/00

[52] U.S. Cl. ..... 355/14 E; 355/14 CH

[58] Field of Search ..... 355/14 E, 14 CH, 14 R, 355/3 R, 67–71

[56] References Cited

U.S. PATENT DOCUMENTS

| | | | |
|---|---|---|---|
| 3,321,307 | 5/1967 | Urbach | 355/14 E |
| 3,525,936 | 8/1970 | Vosteen | 324/72 |
| 3,743,405 | 7/1973 | Morse et al. | 355/68 X |
| 3,788,739 | 1/1974 | Coriale | 355/14 E |
| 3,887,845 | 6/1975 | Michatek | 317/262 A |
| 3,914,049 | 10/1975 | Basu et al. | 355/68 |
| 3,944,354 | 3/1976 | Benwood et al. | 355/14 R |
| 4,063,154 | 12/1977 | Andrus | 355/14 R |
| 4,063,155 | 12/1977 | Buchheit | 355/14 R |
| 4,087,171 | 5/1978 | Yano | 355/14 E |
| 4,176,943 | 12/1979 | Hasebe | 355/67 X |

FOREIGN PATENT DOCUMENTS

| | | | |
|---|---|---|---|
| 2855073 | 5/1979 | Fed. Rep. of Germany | 355/14 CH |
| 53-49436 | 4/1978 | Japan . | |

*Primary Examiner*—Richard L. Moses

*Attorney, Agent, or Firm*—Wenderoth, Lind & Ponack

[57] ABSTRACT

A photoreceptor charge control arrangement to be employed for electrophotographic copying apparatuses wherein a specific circumferential portion on a uniformly charged photoreceptor is first exposed by a referenced exposure source to a specific amount of exposure and successively, the surface potential of the circumferential portion mentioned above is detected either at the relative position immediately before a position for an imagewise light exposing station or at the position juxtaposing the position of the station mentioned above, so that the successive comparison of the surface potential thus detected with a fixed reference is capable of effectively providing an appropriate control signal which can be employed to compensate the amount of exposure of the exposure source, irrespective of the surface condition of the photoreceptor.

6 Claims, 18 Drawing Figures

ELECTROPHOTOGRAPHIC DENSITY CONTROL

BACKGROUND OF THE INVENTION

This invention relates to an electrophotographic copying apparatus or more particularly, to an electrophotographic image density control or a photoreceptor charge control arrangement.

In the situation of varying temperature and humidity characteristics, and further, of consecutive operating duties of an electrophotographic copying apparatus, the steady and uniform distribution of the surface potential on the photoreceptor is not generally expected, causing an undesirable influences on the reproducibility of the images to be transferred, or especially, on the reliable reproducibility of the electrophotographic image density.

More specifically, in the copying apparatus of latent image transfer type wherein a latent image created on the electrophotographic photoreceptor is electrostatically transferred onto a copy paper composed of respective insulating and conductive layers and the image mentioned above is successively developed, the non-uniform distribution or, variation of the surface potential on the above-mentioned photoreceptor is quite undesirable, due to the fact that the variation of the surface potential on the above-mentioned photoreceptor substantially affects the reproducibility of the image to be copied. That is to say, the surface potential relatively representing the original portion having a low picture image density on the surface of the photoreceptor is to be approximately the same level as that to be rendered by a white portion of the original, i.e., non-image bearing portion of the original. Therefore, if the surface potential is undesirably varied from a fixed reference due to the reasons mentioned above in the course of the latent image transferring steps, the transfer of the original portion having a low image density mentioned above is not naturally performed satisfactorily, thus resulting in dimming and further, even fogging of the copied images in the case where the white portion mentioned above is undesirably charged. Such undesirable situations as described in the foregoing is inherent in the electrostatic copying process and is concerned with the copying process even with the copying apparatus of powder image transferring type, in which the predetermined relation between the surface potential of the photoreceptor and the biasing force to be specifically employed for development is to be resultantly varied.

Accordingly, in order to overcoming the inherent disadvantages mentioned above and thereby, to constantly obtain copies having a predetermined image density, various methods comprising a step for detecting the surface potential of the charged photoreceptor and a successive step for controlling the charge amount to be charged onto the photoreceptor subject to the above-mentioned detection have already been proposed.

For example, according to the invention disclosed in U.S. Pat. No. 3,788,739, the photoreceptor has a portion for detection within the area exposed to an image projection so as to be simultaneously exposed to the maximum exposure radiation intensity. Accordingly, measurement of the surface potential of the portion for detection, which has already been exposed as mentioned above, and successive comparison of the surface potential to the fixed reference are arranged to provide a control instruction which can be employed to compensate charge, exposure, transfer and development. However, in the known arrangement as described above, since an electrometer or surface potential detector is disposed in a position following the charging and exposing stations arranged along a process route, even if the arrangement may be capable of controlling charge, exposure, and development in a manner as mentioned above and further maintaining the surface potential to be apparently constant in view of an integral time scale of run, apriori compensation of charge etc. can hardly be accomplished.

More specifically, as may be clear from the discription in the foregoing, the surface potential correspondingly prevailing between the charger and the electrometer can not be compensated, even if the electrometer is to detect the variation of the surface potential on the photoreceptor, which may be caused by the electrical parameters specifically concerning the charger and the radiation lump and/or the successive changes of the temperature and humidity as described earlier. Moreover, such being the case as mentioned above, if the surface potential is to be kept steady in respect to the fixed reference, with the charger and radiation source etc. being momentarily controlled, through the momentary signal output from the electrometer, an oscillation phenomenon, which is to be effected in a control circuitry due to the existence of the specific control time lag, can not be avoided. Therefore, according to the arrangement mentioned above, the momentary outputs are arranged to be impressed onto the control circuitry with the help of an integrating circuit means. However, even such the case as mentioned above, if the capacity of a capacitor to be employed in the integrating circuit means is not large enough, it is natural to take a long period of time before the oscillation is stabilized, or the control mentioned above is often rendered to be unstable. On the contrary, if the capacity of the capacitor is excessive for the intended purpose, the response time for the respective compensation tends to be delayed. Furthermore, even if the capacity of the capacitor is predetermined so as to be in an appropriate range within the two extreme conditions as described in the foregoing, the possible capacity of the control circuit for controlling the respective extremes mentioned above are diminished, thus resulting in a state in which the control circuit means mentioned above is not adaptable for compensating the rather large variation of the surface potential.

Moreover, if the photoreceptor is made of a cylindrical drum and has a deposited or spattering layer of photoconductive material thereon then, the non-uniform deposition of photoconductive material on the drum is naturally expected and therefore, becomes one of the reasons causing the surface potential to be undesirably distributed. Consequently, such being the case as mentioned above, other difficulties for accomplishing an appropriate control are further encountered, as long as the separate positioning of the electrometer with respect to the control circuit means including the charger or the exposing station etc. is left unchanged, the situation of which can be found in the prior art as described in the foregoing.

SUMMARY OF THE INVENTION

Accordingly, an essential object of the present invention is to provide a photoreceptor charge control arrangement, which can effectively compensate an amount of exposure to be effected through an exposing station in response to unsteady variation of surface potential on a photoreceptor with respect to a fixed reference.

Another important object of the present invention is to provide a photoreceptor charge control arrangement of the above-described type, wherein a surface portion for surface potential detection on a photoreceptor body already charged is first exposed by the most preferable, specific predetermined amount of exposure, before a respective detection of surface potential is accomplished either at a relative position immediately before a position of an exposing station or at a position juxtaposing the position of the exposing station.

A further object of the present invention is to provide a photoreceptor charge control arrangement of the above-described type, which is simple in construction and thereby, readily incorporated in various kinds of electrophotographic copying apparatus.

A still further object of the present invention is to provide a photoreceptor charge control arrangement of the above-described type, wherein various kinds of surface detecting means are arranged to be available, so that any kind of electrophotographic copying apparatus can be readily provided with the arrangement of the present invention.

In accomplishing these and other objects according to one preferred embodiment of the present invention, there is provided a photoreceptor charge control arrangement.

More specifically, in an electrophotographic copying apparatus which comprises at least a body having a photoreceptor surface thereon and rotatable in one direction; a corona charging means for charging the photoreceptor surface therewith; a light radiation means for illuminating a surface of an original to be copied; an optical system for introducing an imagewise light to an exposing station positioned at a predetermined position along and apart from a circumferential path of the photoreceptor body; and an erasing means for erasing the residual electrical charge on the photoreceptor surface therewith and positioned relatively prior to the position of the electrical charging means with respect to the direction of rotation of the photoreceptor body so that the residual electrical charge is electrostatically erased before the successive electrical charge is imparted by the corona charging means, the above-mentioned photoreceptor charge control arrangement employed for any kind of electrophotographic copying apparatus and comprising;

(a) a supplementary exposing means positioned between the position of the corona charging means and the position of the exposing station, to thereby provide a predetermined amount of light onto a predetermined circumferential portion of the photoreceptor surface already electrically charged with the corona charging means, wherein the predetermined amount of light is equivalent to a specific amount of light radiated from the light radiation means for substantially reproducing the original portion having the picture density of the minimum reproducible level for a respective copying process to be concerned;

(b) a surface potential detecting means selectively substantially juxtaposed or placed close by the exposing station and disposed immediately before the position of the exposing station with respect to the direction of rotation, to thereby detect the surface potential of the predetermined circumferential portion of the photoreceptor already exposed with the supplementary exposing means; and (c) a control circuitry means capable of controlling the amount of light provided by the light radiation means in response to the variation of surface potential detected by the surface potential detecting means.

Moreover, as far as the surface potential detecting means is concerned, a typical means according to the present invention comprises a shielding member having an aperture facing the predetermined circumferential portion of the photoreceptor surface at one side thereof and including a sheet of a high electric insulating material disposed on the aperture, a detection electrode deposited on the sheet, a relay circuit means, a first amplifier provided with high level input impedance and low level offset current characteristics; a second amplifier for amplifying an output from the first amplifier; a zero compensating circuit means connected to the second amplifier; a zero compensating electrode spaced between the predetermined circumferential portion mentioned above and the aperture; and respective timing signal input terminals for permitting respective signals for the relay circuit means and the zero compensating circuit means to be impressed therethrough, respectively. More specifically, the shielding member is grounded, and the sheet is capable of being grounded through the relay circuit means in response to the signal impressed onto the relay circuit means. Furthermore, the first amplifier and the detection electrode are respectively connected to the relay circuit means, and the zero compensating electrode is grounded and is movable to recede from the space between the predetermined circumferential portion mentioned above and the aperture.

By the arrangement as described in the foregoing, according to the photoreceptor charge control arrangement of the present invention, irrespective of the surface condition of photoreceptor, a respective comparison of the detected surface potential with respect to the fixed reference is effected with the help of the control circuitry means and is capable of effectively providing an appropriate control signal which can be employed to compensate the amount of exposure of the exposure source.

BRIEF DESCRIPTION OF THE DRAWINGS

These and other objects and features of the present invention will become apparent from the following description taken in conjunction with the preferred embodiment thereof with reference to the accompanying drawings in which;

as shown in FIG. 7; according to the present invention.

Before the description of the present invention proceeds, it is to be noted that like parts are designated by like reference numerals throughout several views of the accompanying drawings.

DETAILED DESCRIPTION OF THE INVENTION

Figure 1:
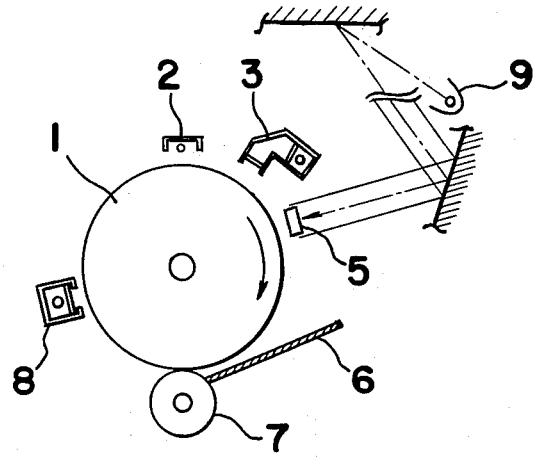
FIG. 1 is a partial schematic sectional view of an electrophotographic copying apparatus of a latent image transfer type in conjunction with one embodiment of a photoreceptor charge control arrangement according to the present invention.

Referring now to FIG. 1, there is shown a partial schematic side sectional view of an electrophotographic copying apparatus of latent image transfer type in conjunction with the present invention.

The copying apparatus mentioned above at least comprises a photoreceptor drum 1, and the other devices employed for performing respective operations of the electrophotographic copying process and including an electric charger or corona charger 2, a supplementary exposing device 3, or an electrometer surface potential detector 5 out of contact with the surface being measured, a supporting member 6, a transferring roller 7 and an eraser 8, each of which is successively disposed around an outer circumference of the photoreceptor drum 1 mentioned above.

Figure 2:
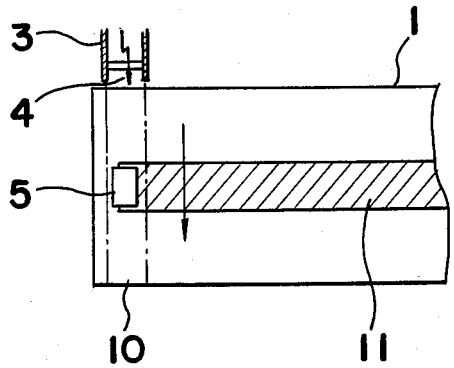
FIG. 2 is a partial side view similar to FIG. 1, particularly showing the locational relationship between a portion for detection of surface potential on the photoreceptor surface and a sensing portion of an electrometer.
Figure 3:
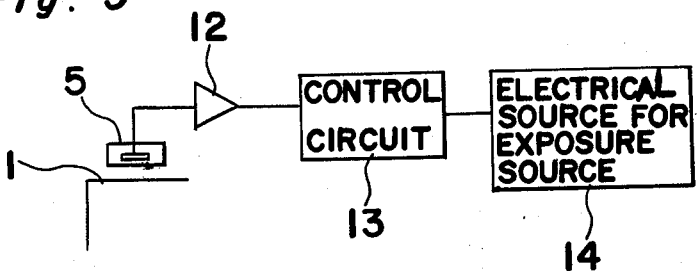
FIG. 3 is a block diagram of a control circuit of a photoreceptor charge control arrangement according to the present invention.

Further referring to FIGS. 2 and 3, there is shown a detailed construction of the arrangement according to the present invention, wherein an exposure light projecting portion 4 of the supplementary exposing device 3 and the probe of the electrometer 5 are both arranged to be spaced from each other in positions above one of the lateral sides of the photoreceptor drum 1 while both being apart from the outer surface of the photoreceptor drum 1. The electrometer 5 thus spaced is to detect the surface potential prevailing on a portion 10 for detection onto which the exposure light projected via the exposure light projecting portion 4 is arranged to be projected as specifically shown in FIG. 2. As is clear from FIGS. 2 and 3, the imagewise light of an original to be copied (not shown) illuminated by an exposure source 9 is successively projected onto an exposure portion 11 on the photoreceptor drum 1, while the exposure portion 11 is always laterally extended from the portion 10 for detection.

With reference to the arrangements of the electrophotographic copying apparatus as described in the foregoing, the electrophotographic density control method according to the present invention is detailed hereinbelow.

To begin with, the whole surface of the photoreceptor drum 1 is charged by the charger 2, while the charging is to be relatively effected in accordance with the clockwise rotation of the photoreceptor drum 1. Following the further rotation of the photoreceptor drum 1, only the portion 10 for detection, which is provided at the lateral end circumferential portion of the photoreceptor drum 1 as mentioned earlier, consecutively begins to be exposed with the help of the supplementary exposure source 3. Successively, the imagewise reflection caused by the radiation-light coming from the exposure source 9 and reflected on an original (not shown here) is to be projected onto the portion 11 relatively fixed as mentioned above in a consecutive manner.

In accordance with the rotation of the photoreceptor drum 1, the portion 10 for detection is naturally simultaneously rotated, and therefore, the surface potential of the segment of the portion 10 for detection coming beneath the electrometer 5 in succession is detected in a consecutive manner. The successive signals output from the electrometer 5 are input into a control circuit 13 through an amplifier 12. The above-mentioned signals indicative of the respective levels of the surface potential are consecutively compared with a fixed reference voltage, i.e., a surface potential of the portion 10 for detection which is detected by the electrometer 5, after being exposed to a specifically predetermined amount of exposure (Lux·sec) effected with the supplementary radiation source 3. In consequence of the comparison mentioned above, if there is the voltage difference between the detected surface potential and the fixed reference mentioned above due to the influences caused by the environmental variations of temperature and/or humidity characteristics, or by continuous copying runs, the voltage (or the electric current) of an electric source 14 for the exposure source is arranged to be selectively increased and decreased subject to the resultant difference mentioned above.

The spacing position of the electrometer 5 is not necessarily juxtaposed in a manner as described earlier, but can be spaced in a position immediately before the portion of the exposure portion 11.

Figure 4:
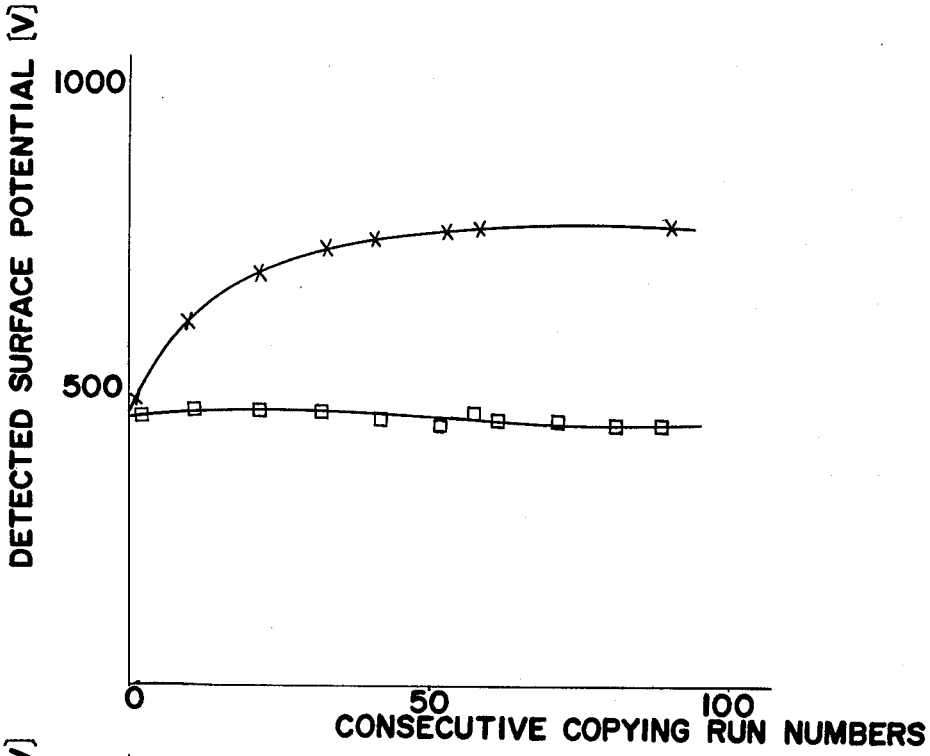
FIG. 4 is a graph showing the specific behavior of the surface potential on the photoreceptor with respect to the number of copies made during a consecutive copying run and particularly illustrating the comparison between the correlation obtained by the control method according to the present invention and that obtained by the prior method.

Generally, following an increase of in the number of consecutive copying runs, the surface potential prevailing on the partial area on the photoreceptor where a relative lower image-density portion of the original has been electrostatically latently imaged is gradually increased with consecutive copy runs, if appropriate compensation is provided for the prevention of the occurrence of the above-mentioned undesirable features (more specifically, the phenomenological characteristics as shown by a respective x dots in FIG. 4). However, according to the present invention, since the electric voltage of the electric source 14 for the exposure source 9 is capable of being increased up to an optimum value with respect to the predetermined reference value in response to the gradual increase of the surface potential, the surface potential of the photoreceptor surface, onto which the imagewise light is to be projected, can be held constant in any conditions of the photoreceptor constituting the photoreceptor drum 1, the feature of which is specifically shown by □ dots in FIG. 4.

Figure 5:
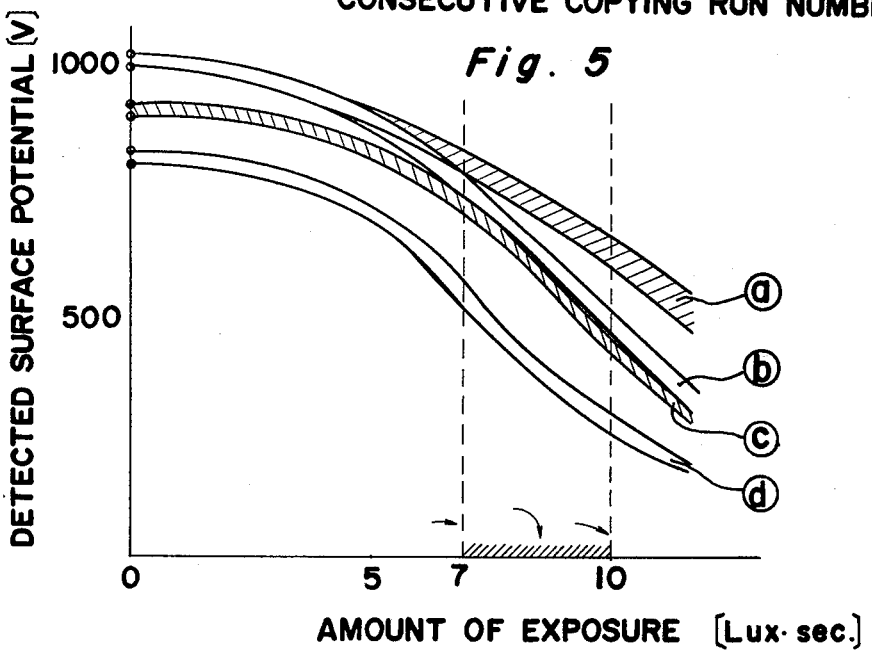
FIG. 5 is a graph showing respective correlations between the surface potential on the photoreceptor and the amount of exposure, with the environmental condition relating to the photoreceptor being chosen as a parameter.

Referring now to FIG. 5, there is shown a correlation between the surface potential (V) of the photoreceptor constituting the photoreceptor drum 1 and the amount of exposure (Lux·sec), with the environmental condition relating to the photoreceptor being chosen as a parameter of this correlation.

More specifically, in FIG. 5, a correlation denoted by ⓐ shows the results obtained in an atmospheric condition of a temperature of 5° C. and a humidity of 30%, just after one hundred copying runs being completed; a correlation denoted by ⓑ shows the results obtained in an atmospheric condition of a temperature of 25° C. and a humidity of 45%, just after one hundred copying runs being completed; a correlation denoted by ⓒ shows the results obtained in an atmospheric condition of a temperature of 35° C. and a humidity of 85%, just after one hundred copying runs being completed; and a correlation denoted by ⓓ shows the results obtained in an atmospheric condition of a temperature of 35° C. and a humidity of 85% without carrying out any copying run. As may be clear from FIG. 5, the respective correlation has a correlating vertical width of surface potential in respect to a fixed certain value of the amount of exposure. However, this is due to the fact that since the thickness of the photoreceptor layered onto the drum is not uniform and, is circumferentially different from point to point on the drum mentioned above, the exact reproduction of the results can not be expected by the measurements carried out in the course of rotation of the photoreceptor drum for every fixed value of amount of exposure.

Furthermore, according to the respective correlations obtained below with an exposure of 7 Lux·sec as well as the respective correlations obtained above with an exposure of 10 Lux·sec, not only are the respective correlations for various measuring conditions superimposed with respect to each other, but also the respective variations of the surface potential in accordance with the variation of exposure are not very steep. Therefore, as far as the respective ranges as mentioned above, the amount of exposure can not be specifically compensated subject to the measurements of surface potential accordingly even through the arrangement of the present invention.

Figure 6A:
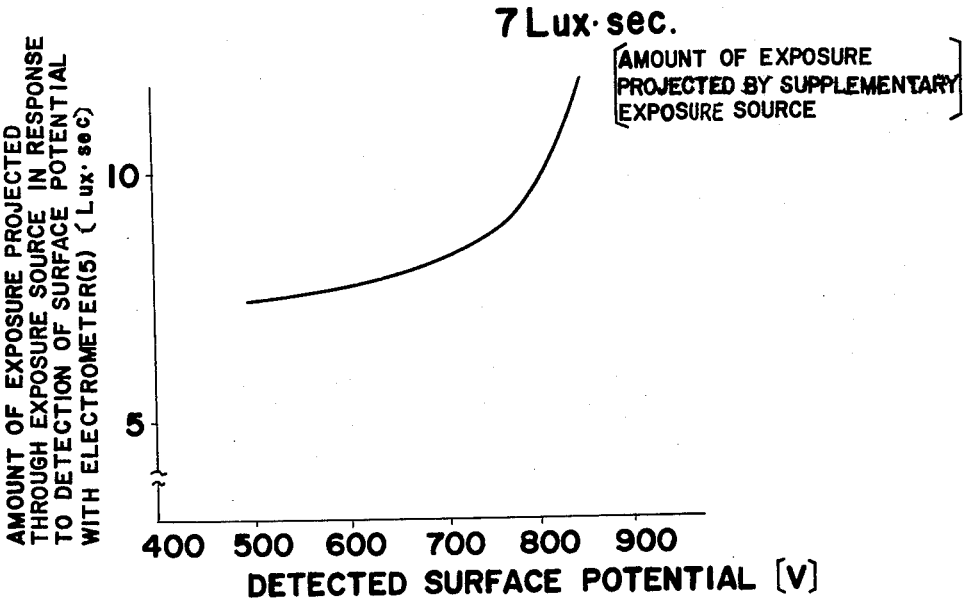
FIGS. 6*a* to 6*d* are graphs respectively showing a correlation between the amount of exposure and the surface potential, with the amount of exposure for the portion for detection being respectively chosen as a parameter.
Figure 6B:
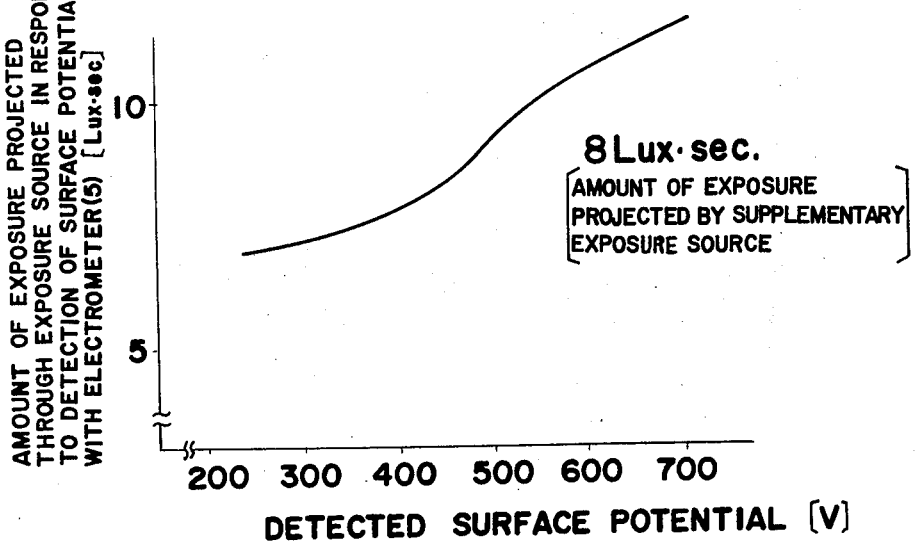
Figure 6C:
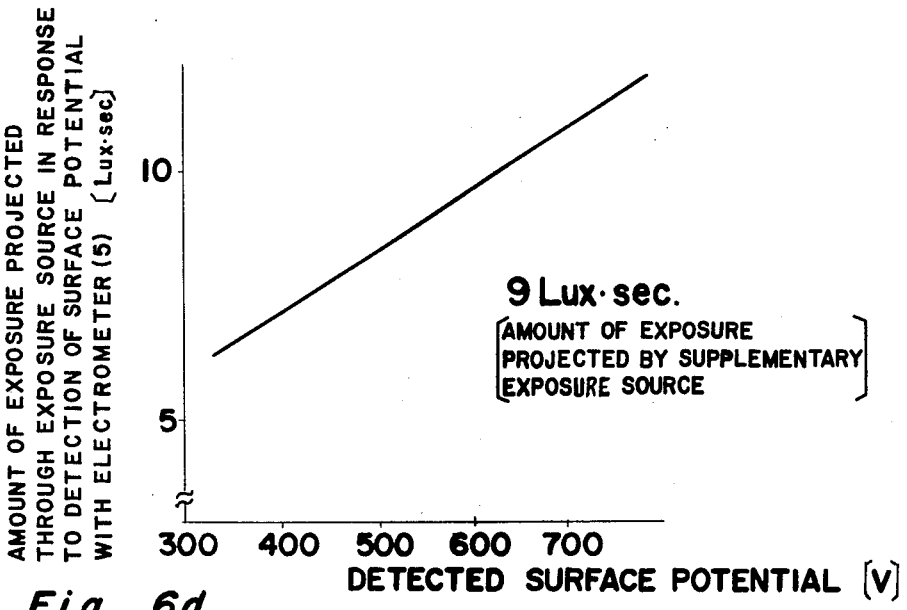
Figure 6D:
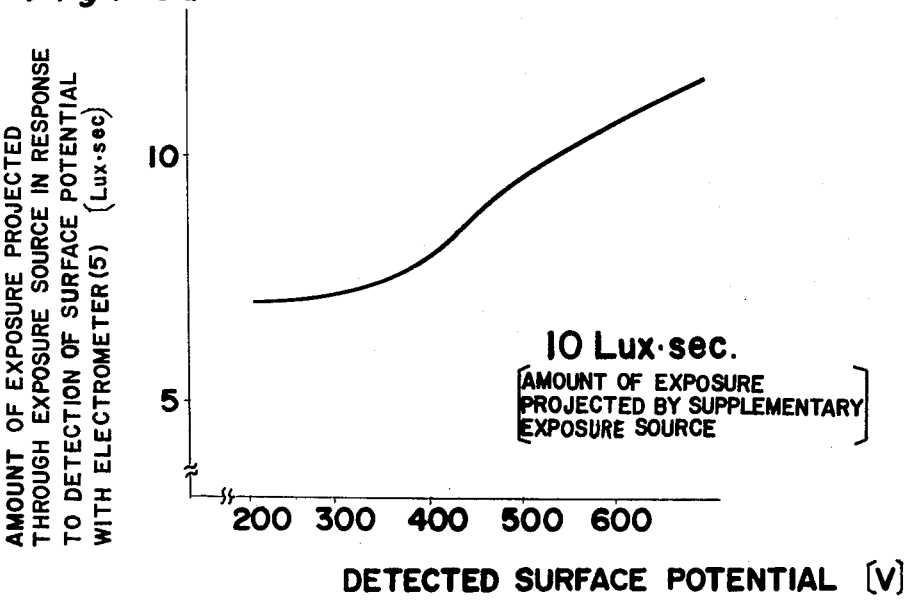

Referring now to FIGS. 6*a* to 6*d*, there are shown other experimental results, which were experimented in connection with the present invention. In the respective experimental run, the surface potential was detected on the photoreceptor 1, which was first uniformly charged and then, consecutively exposed for the respective, specifically predetermined amount of exposure, with the amount of exposure for the portion for detection being respectively chosen as a parameter. By the experiments as mentioned above, the optimum amount of exposure was determined for the portion for detection, which is specific for the arrangement of control circuitry according to the present invention and is capable of constantly effecting the ideal surface potential of 550 V, irrespective of the environmental condition and without including not so much control difficulties. The specific surface potential of 550 V mentioned above is the voltage level corresponding to the level which is high enough for making any original images including rather lower image density portions therein to be reproducible even in consecutive copying runs. However, it is to be noted here that the specific surface potential of 550 V is not critical for every electrophotographic copying process. As is clear from the results as described in FIGS. 6*a* to 6*d*, when the specific amount of exposure for the portion for detection is to be 9 Lux·sec as shown in FIG. 6*c*, the correlation between the amount of exposure and the surface potential is specific and shows a linear relationship. Therefore, such being the case as mentioned above, even if the measured surface potential of the photoreceptor does not fall on the value of 550 V, the above-mentioned value of the surface potential of the photoreceptor can be easily compensated by successive adjusting the luminance of the exposure source in a direct proportional manner with respect to the measured surface potential. More specifically, under any environmental condition, if the amount of exposure for the portion for detection, which is equivalent to that rendered when radiated by the radiation to be effected by the supplementary radiation source 3, is approximately adjusted to the level of the above-mentioned optimum amount of exposure, the surface potential to be rendered by the photoreceptor can be easily held constant at the predetermined level, with the amount of exposure from the radiation source 9 being simultaneously compensated in a fairly easy mode according to the present invention.

Figure 7:
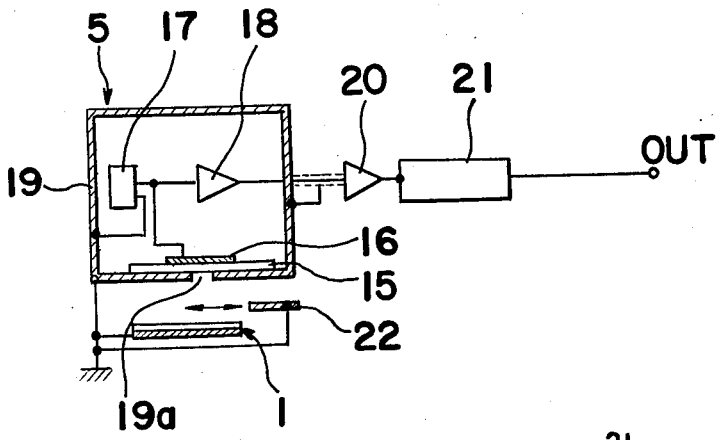
FIG. 7 is a schematic view of one embodiment of an electrometer according to the present invention.

Referring now to FIG. 7, there is shown one embodiment 5 of an electrometer according to the present invention.

The electrometer 5 mentioned above comprises a shielding member 19 including a sheet 15 of a high electric insulating material such as Teflon (name used in trade) disposed on an aperture 19*a*, with a detection electrode 16 being layered by a gold deposition method on the sheet 15 mentioned above, a relay 17, an amplifier 18 provided with a high level input impedance and a low level offset current characteristic; another amplifier 20 for amplifying the output from the above-mentioned amplifier 18; a zero compensation circuit means 21; and a zero compensating electrode 22 to be spaced between the photoreceptor drum 1 and the sheet 15 of a high electric insulating material.

The shielding member 19 is directly grounded, while the detection electrode 16 located on the high insulating sheet 15, which is arranged to be disposed onto the aperture 19*a* provided for the shielding member 19, is capable of being grounded through the relay 17 mentioned above.

Furthermore, the amplifier 18 together with the detection electrode 16 are both connected to the relay 17. As described in the foregoing, the electrometer 5 is arranged to be disposed above one lateral end of the photoreceptor drum 1, and the aperture 19*a* mentioned above is arranged to be positioned against the portion 10 for detection, which has already been exposed to the predetermined amount of exposure (Lux·sec) effected with the supplementary radiation source 3. As is clear from the description in the foregoing, the electrometer 5 according to the present invention is specifically characterized in the following specific two points. That is to say, zero resetting is arranged to be performed in an exact manner with the help of the functioning of the zero compensating circuit 21, which is specifically incorporated in a forwarding disposition in respect to the amplifier 20. Furthermore, according to the electrometer 5 of the present invention, the high insulating sheet 15 is disposed between the detection electrode 16 and the object whose surface potential is to be detected, so that the occurrence of the electric current leakage is prevented within the circuitry arrangement of the electrometer.

Figure 8:
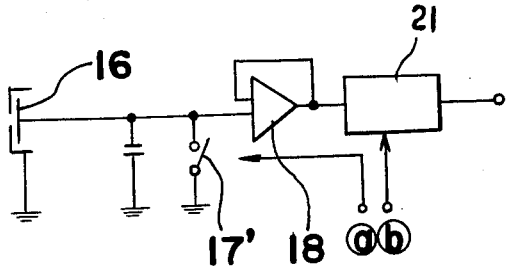
FIG. 8 is a view similar to FIG. 7, particularly showing one simplified schematic view of one modified embodiment of an electrometer, with respective timing signal input terminals for permitting respective actuating signals for respective relay and zero compensating circuit to be impressed therethrough being specifically included.
Figure 9:
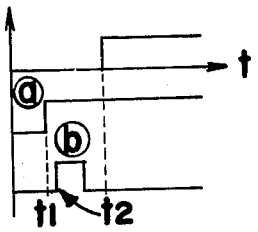
FIG. 9 is a time chart particularly showing the detailed features of the respective actuations for actuating respective relay and zero compensating circuits as described in connection with FIG. 8.
Figure 10:
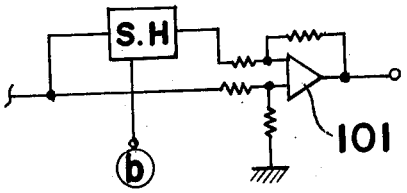
FIG. 10 is a block diagram of the zero compensating circuit according to the present invention.

More specific features of the present electrometer 5 are successively described hereinbelow in conjunction with the description just mentioned above. Referring now to FIGS. 8 and 9, there are shown one simplified schematic diagram of the arrangement for measuring the surface potential by the electrometer, with respective timing signal input terminals (a) and (b) for permitting the actuating signals for the respective relay contact 17' and the zero compensating circuit 21 to be impressed therethrough being specifically included, and a time chart representing the detailed features of the respective actuations mentioned above. As may be clear from FIG. 9, when the zero reset performed, the detection electrode 16 is made to face the grounded electric potential, i.e., the zero point, with a relay contact 17, being in a closed condition. Beginning with the situation as mentioned above, upon a signal being impressed onto the terminal (a) at the time of $t_1$, relay contact 17' is opened. Subsequently, the pulse for actuating the zero compensating circuit 21 is impressed onto the terminal (b) at the time of $t_2$. After the completion of the trailing edge of the pulse mentioned above, the surface of the object to be detected is arranged to face the detection electrode 16. With respect to the zero compensating circuit 21, the detailed construction of the zero compensating circuit 21 according to the present invention is specifically shown in FIG. 10, wherein a sample and hold circuit means (SH) is included. The sample and hold circuit means (SH) is capable not only of being in an operation mode, but also capable of simultaneously sampling the input, as long as the timing signal is input through the terminal (b). The output from the sample and hold circuit means (SH) is to be impressed into a differential amplifier 101, where it is compared with the detected surface potential. Hereby, even if the zero point is varied in association with the impression of the timing signal for causing the relay contact 17' to be opened, the output from the zero compensating circuit 21 is the difference between the sample and hold value and the momentary value correspondingly detected at the moment whereat the sample holding is executed. Therefore, as a matter of fact, since the difference as mentioned above is substantially equal to zero, the precise zero adjustment is always effected in spite of the occurrence of timing actuation of the opening actuation of the relay contact.

The respective timing signals for actuating the relay 17 and the zero compensating circuit means 21 are effected with the help of conventional signal generators. However, more specifically, if an A/D converter, a digital memory circuit and a digital comparator are respectively employed for the input means for the zero compensating circuit 21, the sample and hold circuit and the differential amplifier, and these are combined with a microcomputer means to be incorporated in the arrangement of the present invention, a successive control for the detection of the surface potential is systematically accomplished through the use of a train of actuating timing signals.

Referring back to FIG. 7, in the case of measuring the surface potential of the portion 10 for detection with the arrangement according to the present invention, the relay 17 mentioned above is first actuated so as to ground the detection electrode 16 and subsequently, the zero compensation electrode 22 is moved so as to be temporarily disposed above the photoreceptor drum 1 mentioned above. However, such being the case, since the zero compensating electrode 22 is held at an electrical potential of zero, the electric potential detected by the detection electrode 16 is naturally zero. The relay 17 is subsequently actuated so as to cause the detection electrode 16 to be placed in a non-grounded condition.

Such being the case, the sample and hold signal is input into the zero compensating circuit means 21 thereby to hold the output from the detection amplifier 18, whereby the difference between the outputs of respective held value mentioned above and the output from the detection amplifier 18 is output at a terminal denoted by an OUT as specifically shown in FIG. 7. As is clear from the description in the foregoing, if the output from the zero compensating circuit means does not show the zero electric potential due to the noise involved in association with the actuation of the relay 17 mentioned above and/or offset voltage effected for the amplifier 18, the output electric potential is arranged to be compensated through the above-mentioned held signal with the help of an arithmetic circuit, thereby to effect the output electric potential of zero.

As for the subsequent step of detection of the surface potential, the above-mentioned zero compensating electrode 22 is receded from the aperture **19*a* provided for the shield 19, and then, the surface potential of the photoreceptor is detected. The output value thus obtained is input into the control circuit means 13 via the amplifier 12 disposed before the control circuit means 13 mentioned above, wherein the output mentioned above is compared with the fixed reference, so that a control signal employed for compensating or controlling the voltage (or the electric current) level impressing into the radiation source 14 is provided as specifically shown in FIG. 3**.

The detection electrode 16 and the amplifier provided with a high level input impedance 18 used as the constituents of the detecting system are quite sensitive to changes in the humidity or other surrounding ambient conditions. Therefore, since the value of the surface potential to be detected tends to decrease due to the occurrence of the leakage involved in the detection system mentioned above in a high humidity condition, the electrometer of the present invention is enclosed as a whole by the shield 19 and thus, is sheltered from the surroundings, so that the error involved in the measurement is as small as possible. Furthermore, even if ozone generated by the charger 2 disposed in the vicinity of the arrangement of the surface potential detection is to attack the arrangement mentioned above, the undesirable influences, which would be otherwise effected onto the electrometer mentioned above, can be avoided owing to the fact that the shield 19 itself is grounded.

In spite of the specific provision of the zero compensating electrode 22 as mentioned above, as long as the variation of residual electric potential of the photoreceptor with respect to a certain reference is not so large for the consecutive runs when compared with the respective variations of the surface potential on the photoreceptor correspondingly rendered in succession by the respective portions of low picture image densities of the respective originals, the provision of the zero compensating electrode 22 is not necessarily included in the electrometer mentioned above subject to the condition that the fixed reference of zero is always compensated to the respective values of the residual electric potential themselves.

Figure 11:
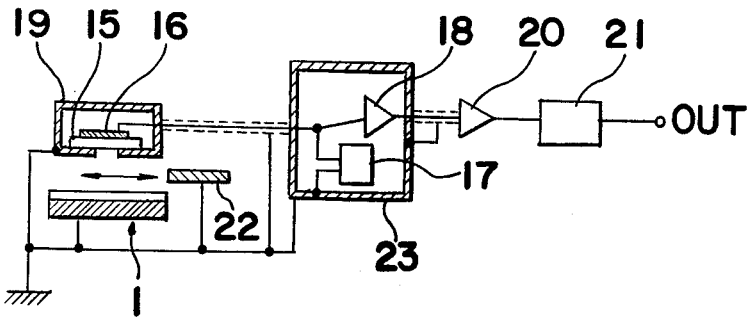
FIG. 11 is a schematic view of one modified embodiment of the electrometer.

Referring now to FIG. 11, there is shown a modified embodiment of an electrometer according to the present invention, wherein the electrometer is composed of two separately provided, shielded portions 19 and 23. More specifically, according to this modified embodiment, the electrometer comprises the detection electrode 16 disposed inside the first shielded portion 19, and the respective amplifier 18 and relay 17 respectively disposed within the second shielded portion 23. By the arrangement as described above, since only the detection electrode 16 and its shield 19 are disposed above the location of the photoreceptor drum 1, the resultant electrometer is very compact, thus permitting a substantial portion of the electrometer to be disposed in a rather narrow space.

Figure 12:
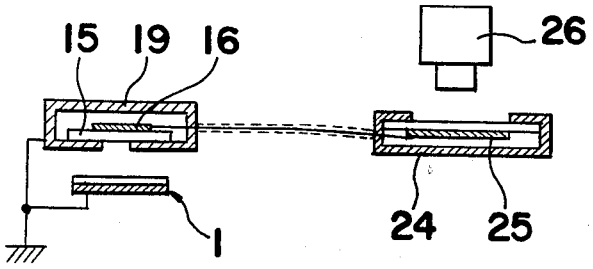
FIG. 12 is a schematic view of one further modified embodiment of the electrometer, as shown in FIG. 11, according to the present invention.

Referring now to FIG. 12, there is shown a further modified embodiment of an electrometer according to the present invention. According to the embodiment mentioned above, instead of the amplifier 18 and relay 17, a supplementary electrode 25 is disposed within the second shield 23, wherein the surface potential detected with the help of the detection electrode 16 disposed within the first shield 19 is detected by an electrometer specifically provided for the present embodiment. In consequence of the arrangement of the present embodiment, in addition to the advantages as mentioned in relation with the embodiment shown in FIG. 11, the present embodiment makes it possible to promote the reproducibility of the measurements.

Figure 13:
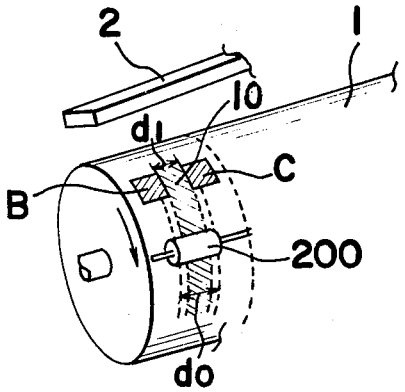
FIG. 13 is a schematic view of one further embodiment of an electrometer.
Figure 15:
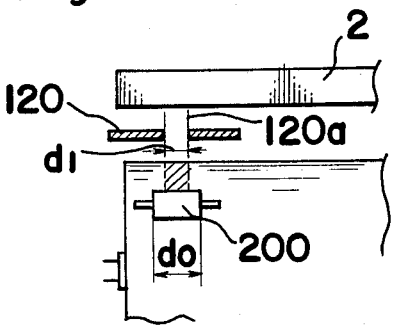
FIG. 15 is a schematic view of one modified embodiment of the electrometer shown in FIG. 13.

Referring now to FIGS. 13 and 15, there are shown still further embodiments of the surface potential detecting arrangements or electrometers, wherein a conductive roller probe 200 is disposed in physical contact with the surface of the photoreceptor 1, so that the resultant electric current is introduced into a detection circuit (not shown here).

As for one of the disadvantages inherent in measurement with the electrometer of the type mentioned above, an undersirable electric current caused by an extraordinary discharging phenomenon is often specifically involved, thus, having resulted in a faulty measurement of the surface potential of the photoreceptor. As far as the disadvantages inherent in the arrangement mentioned above is concerned, the present inventors have already found out the phenomenological fact that the extraordinary discharging phenomenon is specifically brought about by the discharging phenomenon of the electric charger respectively prevailing on the respective outsides of both end-sides of the conductive roller probe 200. Based upon the present finding mentioned above, the surface potential detection arrangement of the above-described type is further improved, wherein the longitudinal length of the surface of the conductive roller probe 200 in physical contact with the portion 10 for detection is arranged to be substantially longer than the lateral width of the portion 10 for detection, as specifically shown in FIG. 13.

According to the present embodiment, the photoreceptor 1 is charged with the help of the charger 2 spaced above the photoreceptor in accordance with the rotation of the photoreceptor 1 as shown in FIG. 13. Similar to the embodiment as shown in FIG. 2, the portion 10 for detection is provided at one end circumferential portion of the photoreceptor drum 1. Furthermore, after the photoreceptor 1 is uniformly charged in a manner as described above, the respective circumferential portions on both sides of the portion 10 for detection, which are respectively denoted by B and C, are specifically exposed in a consecutive manner with the help of the specific exposure arrangement disposed at a position which is relatively forward to the position of the charger 2 mentioned above. As specifically shown in FIG. 14, according to the present embodiment, the exposure step mentioned above is specific, and the respective electric potentials of the portions as denoted by B and C are degraded from an initial charging value of Vo to a final charging value of $V_1$ through the light exposure. The final charging value $V_1$ mentioned above is defined in a value corresponding to the minimum whereat the surface charge prevailing on the photoreceptor 1 is at least transferrable to the conductive roller probe 200 or a lesser value by appropriately adjusting the exposure intensity of the specific exposure arrangement mentioned above. The lateral width of the portion 10 for detection is predetermined to be "$d_1$", and the longitudinal length of the conductive roller probe 200 is substantially "$d_o$", and these dimensions are arranged to satisfy the following relationship, i.e., $d_o > d_1$. For the specific degradation of the surface potential of the circumferential portions denoted by B and C due to the reason as mentioned above, the respective circumferential portions denoted by B and C are only exposed with the help of the specific exposure arrangement. The specific exposure arrangement is an exposure shielding member, and has a pair of apertures spaced from each other by the length of $d_1$ on the member while the respective lateral dimensions being corresponding to those of the respective segments of B and C respectively, whereby the exposure shielding member is properly spaced between the supplementary exposure mentioned earlier and the photoreceptor 1, the respective circumferential portions denoted by B and C are exposed, with the portion 10 for detection mentioned above being left in a non-exposure condition accordingly.

Figure 14:
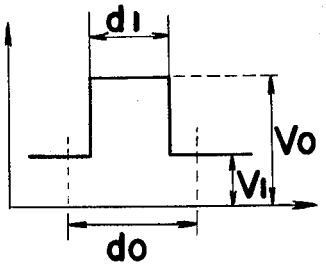
FIG. 14 is a graph showing a surface potential distribution specifically effected on the portion for detection of the surface potential in preparation for measuring the surface potential with the electrometer as shown in FIG. 13.

Referring now to FIG. 14, there is shown a resultant surface potential distribution, wherein the surface potential of the circumferential portion having the lateral width of $d_1$ is Vo, while the surface potentials of the respective side circumferential portions are degraded so far the value of $V_1$.

Owing to the width arrangements just mentioned above together with the degradation of respective surface potentials of the circumferential portions denoted by B and C in a manner as described in the foregoing, the occurrence of the extraordinary discharging phenomenon can hardly be involved in the measurements any more and thereby, the surface potential can be now precisely detected.

Referring now to FIG. 15, there is shown a modified embodiment of the embodiment shown in FIG. 13, wherein the width of the portion 10 for detection is predeterminedly adjustable so as to specifically prevent the occurrence of the measurement errors as specifically indicated in relation with the former embodiment as shown in FIG. 13.

More specifically, according to the present embodiment, a shield means 120 having a slit 120*a* of the width of $d_1$ is spacedly disposed between the charger 2 and the photoreceptor 1, whereby the corresponding width of $d_1$ for the portion for detection is only charged by the charger 2 mentioned above.

Although various types of electrometers according to the present invention are described in the foregoing, as specifically shown in FIG. 3, the successive detection signals of the surface potential of the photoreceptor drum 1, which are output from the electrometer 5, are resultantly input into the control circuit means 13 through the amplifier 14, irrespective of the type of the electrometer to be employed. The above-mentioned signals indicative of the respective levels of the surface potential are consequently compared with the fixed voltage, whereby if there is a voltage difference between the detected surface potential and the fixed reference due to the influences of the variations of temperature and/or humidity characteristics and/or the occurance of continuous copying runs, the voltage of the electric source for the exposure source are compensated subject to the resultant difference mentioned above.

As is clear from the description in the foregoing, the specific circumferential portion on the uniformly charged photoreceptor is first exposed with the referenced exposure source and subsequently, the surface potential of the circumferential portion mentioned above is detected either at the relative position immediately before the position for the imagewise light exposing station or at the position corresponding to the position of the station mentioned above, so that the successive comparison of the surface potential thus detected with the fixed reference is capable of effectively providing the appropriate control signal which can be employed to compensate the amount of the exposure of the exposure source, irrespective of the surface condition of the photoreceptor.

Furthermore, in addition to the advantages as mentioned above, since the surface potential detection prove or portion constituting the electrometer is positioned in proximity of the imagewise light exposing station or at the position corresponding to the position of the station mentioned above, the integrating circuit means and the like for preventing the occurrence of the electric oscillation phenomenon to be often effected in the control circuitry subject to the control time lag are not necessarily included, thus resulting in a further advantage wherein the present invention can be effected at a low cost.

Although the present invention has been fully described by way of example with reference to the accompanying drawings, it is to be noted that various changes and modifications are apparent to those skilled in the art. Therefore, unless otherwise such changes and modifications depart from the scope of the present invention, they should be construed as included therein.

What is claimed is:

1. In an electrophotographic copying apparatus which at least comprises a photosensitive member having a photoreceptor surface thereon while being rotatable in one direction; a corona charging means for charging said photoreceptor surface therewith; a light radiation means for illuminating a surface of an original to be copied therewith; an optical arrangement for introducing an imagewise light to an exposing station positioned at a predetermined position along and apart from a circumferential path of said photoreceptive member; and an erasing means for erasing the residual electrical charge on said photoreceptor surface therewith while being positioned relatively prior to the position of said corona charging means with respect to the direction of rotation of said photoreceptive member so that said residual electrical charge is electrostatically erased before the successive electrical charge is to be imparted with said electrically charging means, a photoreceptor charge control arrangement to be employed for said electrophotographic copying apparatus which comprises;

(a) a supplementary exposing means for projecting a predetermined amount of light onto a predetermined circumferential portion of said photoreceptor surface having been already electrically charged with said corona charging means, said supplementary exposing means being positioned between said position of said corona charging means and said position of said exposing station while being along and apart from said circumferential surface of said photoreceptive member, said predetermined amount of light being equivalent to a specific amount of light radiated from said light radiation means for substantially reproducing the original portion having the image density of the minimum reproducible level for a respective copying process to be concerned;

(b) a surface potential detecting means for detecting the surface potential of said predetermined circumferential portion of said photoreceptor having been already exposed with said supplementary exposing means, said surface potential detecting means being placed at said exposing station and being disposed immediately before said position of said exposing station with respect to said direction of rotation; and (c) a control circuitry means capable of controlling said amount of light to be given by said light radiation means in response to the variation of surface potential detected by said surface potential detecting means.

2. A photoreceptor charge control arrangement as claimed in claim 1, wherein said surface potential detecting means comprises a shielding member having an aperture facing said predetermined circumferential portion of said photoreceptor surface at one side portion thereof and including a sheet of a high electric insulating material disposed on said aperture, a detection electrode deposited on said sheet, a relay circuit means, a first amplifier provided with a high level input impedance and a low level offset current characteristics; a second amplifier for amplifying an output from said first amplifier; a zero compensating circuit means connected with said second amplifier; a zero compensating electrode to be spaced between said predetermined circumferential portion of said photoreceptor surface and said aperture; and respective timing signal input terminals for permitting respective signals for said relay circuit means and said zero compensating circuit means to be impressed therethrough, respectively, said shielding member being grounded, with said sheet being capable of being grounded through said relay circuit means in response to said signal impressed onto said relay circuit means, said first amplifier and said detection electrode being respectively connected to said relay circuit means, said zero compensating electrode being grounded and being movable to recede from a space prevailing between said predetermined circumferential portion of said photoreceptor surface and said aperture.

3. A photoreceptor charge control arrangement as claimed in claim 1, wherein said surface potential detecting means comprises a first shielding member having an aperture facing said predetermined circumferential portion of said photoreceptor surface at one side portion thereof and including a sheet of a high electric insulating material disposed on said aperture and a detection electrode deposited on said sheet; a second shielding member including a relay circuit means and a first amplifier provided with a high level impedance and a low level offset current characteristics; a second amplifier for amplifying an output from said first amplifier; a zero compensating circuit means connected with said second amplifier; a zero compensating electrode to be spaced between said predetermined circumferential portion of said photoreceptor surface and said aperture; and respective timing signal input terminals for permitting respective signals for said relay circuit means and said zero compensating circuit means to be impressed therethrough, respectively, said first and second shielding members being respectively grounded, with said sheet being capable of being grounded through said relay circuit means in response to said signal impressed onto said relay circuit means, said first amplifier and said detection electrode being respectively connected to said relay circuit means, said zero compensating electrode being grounded and being movable to recede from a space prevailing between said predetermined circumferential portion of said photoreceptor surface and said aperture.

4. A photoreceptor charge control arrangement as claimed in claim 1, wherein said surface potential detecting means comprises a first shielding member having a first aperture facing said predetermined circumferential portion of said photoreceptor surface at one side portion thereof and including a high electric insulating material disposed on said aperture and a detection electrode deposited on said sheet; a second shielding member having a second aperture at one side portion thereof and including a supplementary electrode for detection; and an electrometer facing said supplementary electrode through said second aperture, said detection electrode and said supplementary electrode being connected with respect to each other with said first shielding member being grounded.

5. A photoreceptor charger control arrangement as claimed in claim 1, wherein said surface potential detecting means comprises a sample hold circuit means for holding a value detected as a sample hold value in response to a timing signal arbitrarily input thereto, and a comparator circuit means for comparing a value detected simultaneously with said sample hold timing with said sample hold value, a zero adjustment of said potential detecting means executed in response to an output from said comparator circuit means.

6. A photoreceptor charger control arrangement as claimed in claim 1, wherein said surface potential detecting means comprises a conductive roller probe and a means for adjusting the width of a circumferential portion of said photoreceptor for said detection, the width of said roller probe rolling on said circumferential portion being substantially wider than said adjusted width of said circumferential portion for detection.

* * * * *